US005488212A

United States Patent [19]

Fukushi et al.

[11] Patent Number: 5,488,212

[45] Date of Patent: Jan. 30, 1996

[54] SWITCHING DEVICE FOR AN ON-LOAD TAP CHANGER

[75] Inventors: Akira Fukushi; Tomio Yamaguchi, both of Kanagawa, Japan

[73] Assignee: Fuji Electric Co., Ltd., Kawasaki, Japan

[21] Appl. No.: 326,098

[22] Filed: Oct. 19, 1994

[30] Foreign Application Priority Data

Oct. 19, 1993 [JP] Japan ..... 5-260292

[51] Int. Cl.[6] ..... H01H 5/08

[52] U.S. Cl. ..... 200/400; 74/2; 200/48 R; 200/49; 200/411; 200/424; 200/427; 200/429; 200/430; 200/440

[58] Field of Search ..... 200/48 R, 49, 200/411, 400, 416, 424, 425, 426, 428, 430, 431, 436, 440, 462, 465, 466, 501, 337, 17 R, 19 R, 30 R, 33 R, 427, 429; 74/97.1, 2

[56] References Cited

FOREIGN PATENT DOCUMENTS

| | | | |
|---|---|---|---|
| 10320 | 5/1895 | Switzerland | 200/411 |
| 24739 | 3/1900 | United Kingdom | 200/462 |
| 19855 | 4/1908 | United Kingdom | 200/462 |

*Primary Examiner*—Henry J. Recla
*Assistant Examiner*—Arnold T. Lucero
*Attorney, Agent, or Firm*—Brumbaugh, Graves, Donohue & Raymond

[57] ABSTRACT

Disclosed is a switching device for a tap changer comprising an input lever and an output lever rotatably attached to a shaft. The output lever is provided for making contact with a selected one of a first tap and a second tap. The output lever has a cammed surface at its base for securing a position of the output lever to make contact with the first tap and for preventing the output lever from rotating about the shaft. The device also includes a spring for pulling the output lever toward the input lever, and a clutch, rotatably attached to the shaft, which has a slot. A latching apparatus engages the clutch. The device further includes a pin which is fixedly attached to the input lever and disposed within the slot. The pin drives the clutch to engage the latching apparatus. In operation, after the input lever has been pulled away from the output lever by a predetermined angle, the pin drives the clutch to engage the latching apparatus, thereby freeing the cammed surface from the latching apparatus. This allows the output lever to freely rotate. The output lever is then pulled by the spring toward the input lever to make contact with the second tap.

10 Claims, 4 Drawing Sheets

SWITCHING DEVICE FOR AN ON-LOAD TAP CHANGER

FIELD OF THE INVENTION

The present invention relates to changeover switches in on-load tap changers which are utilized to change the taps fitted to power transformer windings. More specifically, it relates to a switching device for an on-load tap changer having an input lever and output lever coupled by a spring. The output lever is driven, and the quick-break action is performed, by virtue of potential energy stored in the spring. The energy is transferred to the output lever via the spring as a result of rotational motion of the input lever.

BACKGROUND OF THE INVENTION

Conventional switching devices typically comprise an input lever and an output lever coupled by a stored-energy spring. The input lever and the output lever, sharing a common axle, rotate freely of one another.

The output lever has a cammed surface at its base which is generally rounded and concave relative to the common axle. The cammed surface also has a left edge and a right edge which are generally convex relative to the common axle.

A latching device engages the cammed surface of the output lever, and specifically, it selectively engages one of the left edge and the right edge of the cammed surface, thereby securing the lever in place and preventing it from rotating freely. The latching apparatus includes a left latch and a right latch. The left latch rotates on a left pivot and is connected to a latch spring. The right latch rotates on a right pivot and is also connected to the latch spring. When positioned on the quick-break device, the latching device forms a V-shape. The latching spring urges the left latch and the right latch toward one another so that the left latch and the right latch tend to pinch the cammed surface.

The left latch engages and secures the left edge of the cammed surface when the output lever is fully rotated in the counterclockwise direction. The right latch engages and secures the right edge of the cammed surface when the output lever is fully rotated in the clockwise direction.

The latching device is engaged by a base section of the input lever. For example, as the input lever rotates in a counterclockwise direction, the base section comes in contact with either the right or left latch. The force exerted by the base tends to force the right latch away from its seat in the edge of the cammed surface, thereby releasing the output lever.

When, for example, a changeover from an odd-numbered tap to an even-numbered tap is desired, the input lever is mechanically rotated in a counterclockwise direction to an interim position. As the input lever rotates in a counterclockwise direction, the stored-energy spring is stretched, thereby transferring potential energy to the stored energy spring.

The output lever is held in place by the right latch, which, due to the force exerted by the latch spring, engages the right edge of the cammed surface. As the input lever rotates, a section of its base forces the right latch away from the right edge of the cammed surface. When the force exerted by the base of the input lever on the right latch exceeds the force exerted by the latch spring, the right latch passes over the right edge of the cammed surface, and the output lever is free to rotate in a counterclockwise direction, i.e., the output lever is tripped.

At this point, the potential energy stored in the stored-energy spring is released, and the output lever is pulled in a counterclockwise direction toward the input lever. The output lever continues to rotate until the left edge of the cammed surface is captured by the left latch. At this point in time, the output lever is now on the other side of the switch, in the even-numbered tap position, and the changeover process is complete.

There are a number of problems with conventional switching devices. First, the output lever is typically tripped before the stored energy spring has been stretched to its maximum limit; hence, it is extremely difficult with conventional devices to delay the switching operation until the spring has been fully stretched and a sufficient amount of potential energy is stored in the spring. Second, the operator is unable to precisely control the exact angular position of the input lever before the output lever is tripped. Third, due to the typically large cammed surface that is on the base of the output lever, the size of these conventional switching devices is typically larger than desired.

A number of attempts have been made to solve the problems discussed above. For example, Japanese Provisional Patent Publication TOKUKAISHO No. 108219 of 1981 attempts to solve the problems by using an output lever having enlarged cams. According to this patent, the enlarged cams 107 and 108 increase the space between the latching levers 109 and 110. The enlarged cams enables the output lever to receive sufficient starting torque when the output lever has started. The initial breaking speed of the changing contacts is boosted thereby preventing the output lever from being delayed mid-course. Problems exist with this disclosure, however, because the enlarged levers require additional space which is not readily available and the production costs are high.

Another solution was presented in Japanese Provisional Patent Publication TOKUKAISHO No. 132021 of 1980. This reference discloses a coiled compression spring which is utilized as a stored-energy spring, wherein the spring is disposed axisymmetrically between an input case and an output case of a flat, U-shaped device which retains 30 the spring inside the U-shape. A driving source (motor) provides the driving power to compress the spring by moving the input and output cases in the direction of the spring axis. A latch-tripping arm which is fixed to the input case is simultaneously moved. A cam formed on the rim of a circular plate receives the rotational force from the spring. The arm of a latching lever that supports a cam follower with which it engages through the output case is integrated into the drive shaft of the changeover contacts. As a result the quick-break action begins at the position of maximum deformation of the spring.

However, there are a number of problems associated with the disclosed technique. Generally, the structural dimensions around the latching levers are too large. This is due, in part, to the fact that the cams are enlarged.

SUMMARY OF THE INVENTION

The object of the present invention is to develop a switching device for a tap changer which starts the switching action when the spring is in a position of maximum deflection.

Another object of the invention is to provide a switching device having a smaller size than currently available with conventional switching devices.

A further object of the invention is to provide a switching device which delays the tripping of the output lever, until the input lever is positioned at a predetermined angle from the output lever.

In order to solve the prior art problems, this invention provides a switching device for a tap changer. The device comprises a shaft, and an input lever which is rotatably attached to the shaft. Also rotatably attached to the shaft is an output lever. Depending on whether the device is in an odd-numbered or an even-numbered tap position, the output lever makes contact with a selected one of a first tap and a second tap.

The output lever has a cammed surface at its base for securing a position of the output lever to make contact with the first tap. The cammed surface also engages the latching apparatus to prevent the output lever from rotating about the shaft.

Further, the device has a clutch which is rotatably attached to the shaft.

The device has a spring for pulling the output lever toward the input lever. The spring has two ends. One end is fixedly attached to the input lever and the other end of the spring is fixedly attached to the output lever. The spring is utilized to store potential energy before the output lever is pulled toward the input lever.

The device further includes a latching apparatus for engaging the clutch. The latching apparatus has a first latch, a second latch and a latch spring. The first latch has a first end which is pivotally attached to a first pivot. The first latch also has a second end which includes a first means for securing the output lever in the first position. The first means includes a cam follower for engaging the edge of the cammed surface to secure the position of the output lever.

The second latch has a first end which is pivotally attached to a second pivot. The second latch also has a second end which includes a second means for securing the output lever in a second position making contact with the second tap. The second means includes a cam follower for engaging an edge of the cammed surface to secure the position of the output lever.

The latching apparatus also includes a latch spring which couples the first latch with the second latch. When the latching apparatus is positioned on the switching device, the first latch and the second latch are positioned in the shape of a V.

The cammed surface at the base of the output lever is disposed adjacent to the latching apparatus. Specifically, it is disposed between the first latch and the second latch. The cammed surface has a first edge for engaging the latching apparatus when the output lever is in a first position, making contact with the first tap, and a second edge for engaging the latching apparatus when the output lever is in a second position, making contact with the second tap.

The clutch further includes a slot. The clutch also has a roller follower positioned at its base. The roller follower engages the latching apparatus.

The device additionally includes a pin, fixedly attached to the input lever and disposed within the slot in the clutch. The pin drives the clutch into an engagement with the latching apparatus.

The switching device operates as follows: Initially, the input lever is pulled away from the output lever. During this time, the clutch remains in a stationary position because the pin is free to move within the slot in the clutch. As the input lever is pulled, the spring is stretched. Once the input lever has been rotated to a predetermined angle, the pin comes in contact with a side wall of the slot within the clutch. The pin begins to drive the clutch against the latching apparatus. The roller following, disposed on the base of the clutch, engages the latching apparatus and applies a force to overcome the force of the latch spring. When sufficient force is applied by the roller follower, the latching apparatus is freed from an edge of the cammed surface, allowing the output lever to freely rotate about the shaft. Due to the potential energy in the spring, the output lever is then pulled toward the input lever to make contact with the second tap.

Unlike the prior art switching device described above, the inventive device does not use a base section of the input lever to engage the latching apparatus.

The present invention attempts to solve the problems typically inherent in a switching device; namely, the switching action begins before the stored-energy spring has reached a point of maximum extension, and the size of the device is too large. These problems are solved by utilization of the clutch which controls the driving and tripping actions of the latching apparatus. Throughout the majority of the travelling range of the input lever, until the input lever is pulled away from the output lever by a predetermined angle, the clutch remains static because the drive pin is able to freely move in the slot. Until the input lever reaches the predetermined angle, the pin does not come in contact with a side wall of the slot. Thus, the clutch can not push the latching apparatus away from the cammed surface. During this period, the spring can not pull the output lever because the output lever is secured by the latching apparatus.

The inventive device enables one to utilize a compact clutch, thereby reducing the spacing between the first and second latch. Further, use of the clutch enables one to provide a switch device in which the switching action begins when the spring is at a position of maximum deflection.

Furthermore, the present invention enables one to construct a smaller switch device, made of simplified components, and which is more economical to construct.

DETAILED DESCRIPTION OF THE INVENTION

Figure 3:
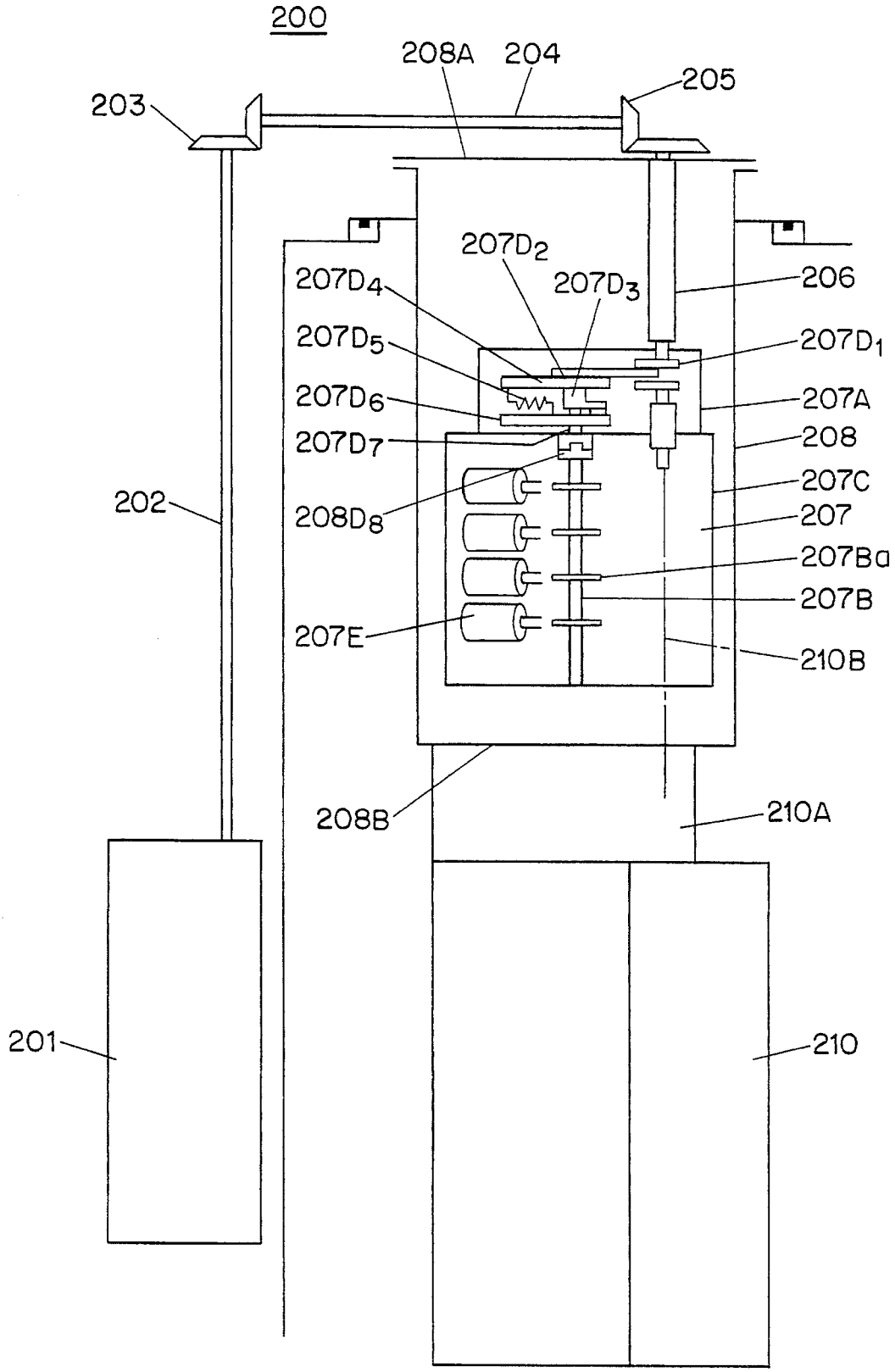
FIG. 3 shows a typical on-load tap changer which uses a switching device.

FIG. 3 illustrates a conventional on-load tap changer 200 which utilizes a switching device 207A. The changer 200 comprises 1) a tap selector 210 which is disposed between the tap windings of a transformer or reactor and the neutral point of the transformer, 2) a changeover switch 207, 3) a tap selection driving mechanism 210A which carries out the tap selection and tap-changing operations, and 4) the switching device 207A.

The driving force for the tap selector drive mechanism 210A is transmitted from an electric motor located in an electric motor operator 201. The driving force then passes consecutively through a speed reducer (not illustrated), a vertical transmission shaft 202, a first bevel gear 203, a horizontal transmission shaft 204, a second bevel gear 205, and an insulated drive shaft 206.

The rotational force transmitted to the insulated drive shaft 206 is also transmitted to the tap selector drive shaft 210B through a crank 207$D_1$ on the switching device 207A.

The conventional structure discussed above operates as follows:

When a tap change instruction is issued to the electric motor operator 201, the electric motor within the electric motor operator 201 begins to operate. The motor's rotational force is transmitted through the speed reducer (not illustrated), then through the vertical transmission shaft 202, the first bevel gear 203, the horizontal transmission shaft 204 and the second bevel gear 205, to the insulated drive shaft 206. This rotational force is then transmitted to tap selector drive shaft 210B through insulated drive shaft 206 and the crank 207$D_1$ with which it is rigidly integrated, thereby applying a driving force to the tap selector driving mechanism 210A.

As a result of the above operations, the insulated drive shaft 206 and the rigidly integrated crank 207$D_1$ simultaneously rotate around the axis of the insulated drive shaft 206 and a tension connecting rod 207$D_2$, thereby causing an input plate 207$D_4$ to rotate in a clockwise or counterclockwise direction around a rotating shaft 203$D_3$ to extend an energy-storing tension spring 207$D_5$.

When the rotational angle of the input plate 207$D_4$ exceeds a prescribed value, a latch that obstructs the rotation of the output plate 207$D_6$ is released, enabling the output plate 207$D_6$ to rotate around the rotating shaft 207$D_3$, with the result that the rotational force is transmitted to a cam shaft 207B through an output shaft 207$D_7$ and a clutch 207$D_8$. The cam shaft 207B is fitted with four separate cam plates 207Ba, and four cranks (not illustrated) that engage with each of four cam plates 207Ba.

To complete the tap-switching process, the driving spring force drives the opening and closing actions of each vacuum valve 207E in the sequentially prescribed order.

Figure 4:
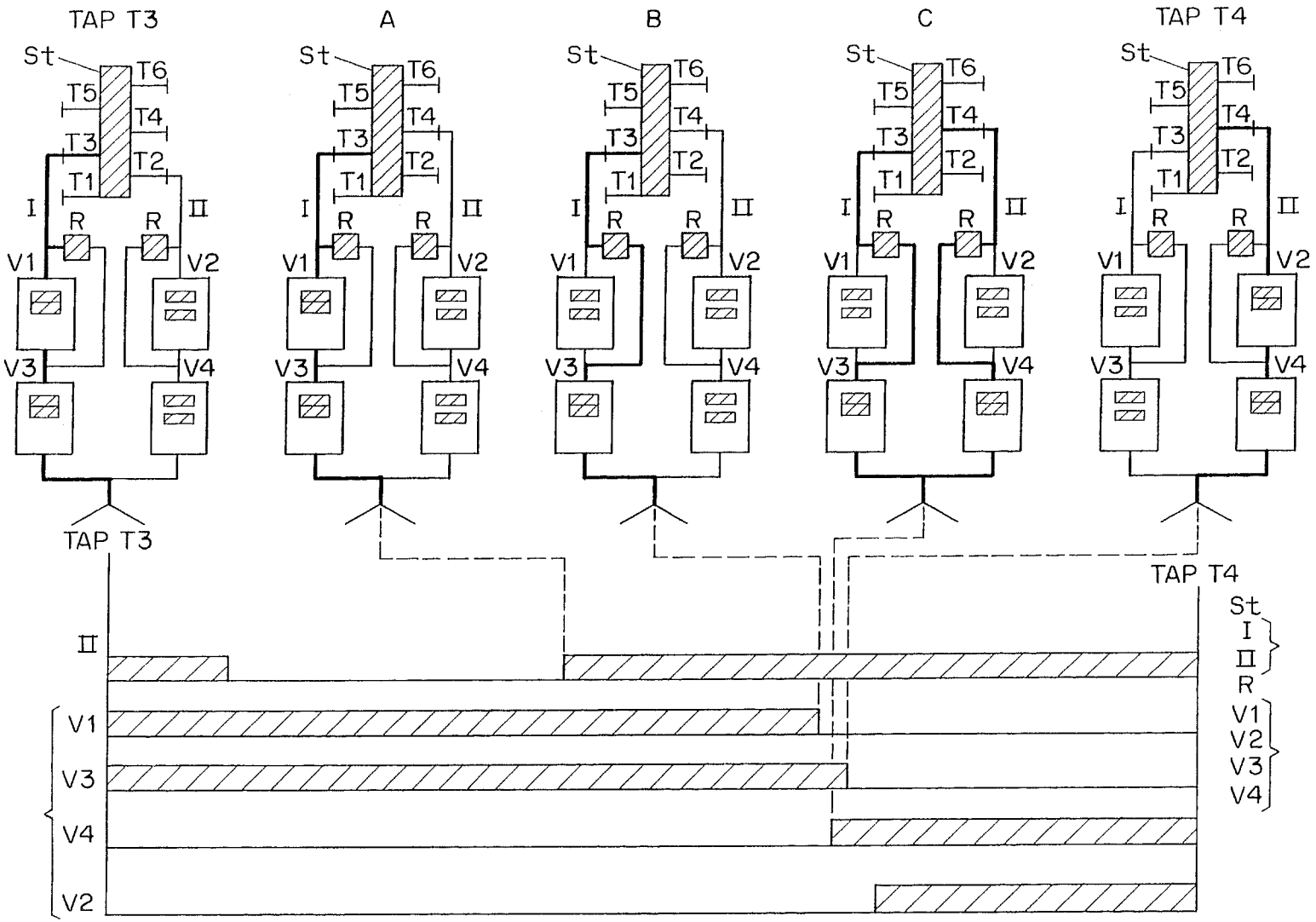
FIG. 4 provides a diagram showing the tap changeover operation in the on-load tap changer of FIG. 3.

FIG. 4 shows a diagram of a transformer or reactor during a changeover from a tap T3 position to a tap T4 position. When a tap change is desired, instructions are issued to the electric motor operator 201 (FIG. 3) which results in the rotational force of the electric motor being transmitted to the insulated drive shaft 206. The rotational force is further transmitted to the tap selector drive shaft 210B through the crank 207$D_1$.

Referring to FIG. 3, the tap selection operation is complete upon the first stage of rotation of the tap selector drive shaft 210B by virtue of a Geneva mechanism, which is an intermittent drive mechanism fitted to tap selector drive mechanism 210A. Next, sequential operation, or the four vacuum valves 207E in the changeover switch 207, is awaited.

As shown in FIG. 3, because it takes time to store energy in the energy-storing tension spring 207$D_5$ of the switching device 207A, the tap selection operation for the tap selector is already complete when the stored-energy tension spring has been extended to the prescribed value previously mentioned. Changeover from tap T3 to tap T4 is conducted in this state.

As shown in part A of FIG. 4, vacuum valves V1 and V3 on the tap T3 side are originally in the closed position. First, the energy-storing tension spring 207$D_5$ (FIG. 3) is extended the desired distance, and the latch that obstructs the rotation of output plate 207$D_6$ is released. Next, the cam shaft 207B begins to rotate, and due to differences of cam angle around the axis involving the cam profile from convex to concave or from concave to convex on the cam face in each of the four cam plates 207Ba fitted to cam shaft 207B, the following actions occur: (a) vacuum switch V1 opens (part B of FIG. 4); (b) vacuum switch V4 closes (part C of FIG. 4); (c) vacuum switch V3 opens; and (d) vacuum switch V2 closes. At this point the changeover from tap T3 to tap T4 is complete. The sequential operation of the vacuum valves in the order V1, V4, V3, V2 after cam shaft 207B begins to rotate and drive is completed in less than 0.1 seconds.

As further shown in FIG. 4, the tap changer includes current-limiting resistors, indicated by the letter R.

Figure 2A:
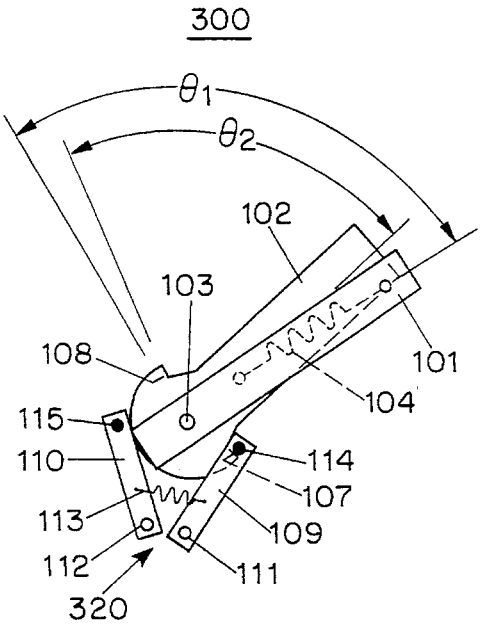
FIG. 2a PRIOR ART
FIG. 2*a* shows a conventional switching device in an odd-numbered tap position.
Figure 2B:
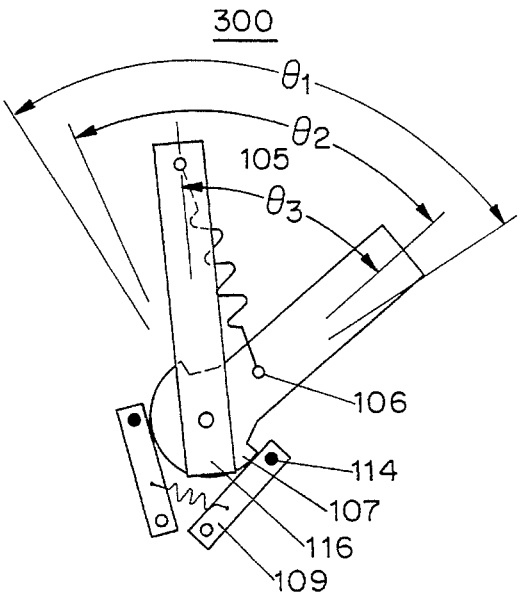
FIG. 2b PRIOR ART
FIG. 2*b* shows a switching device at instant the latching lever is tripped.
Figure 2C:
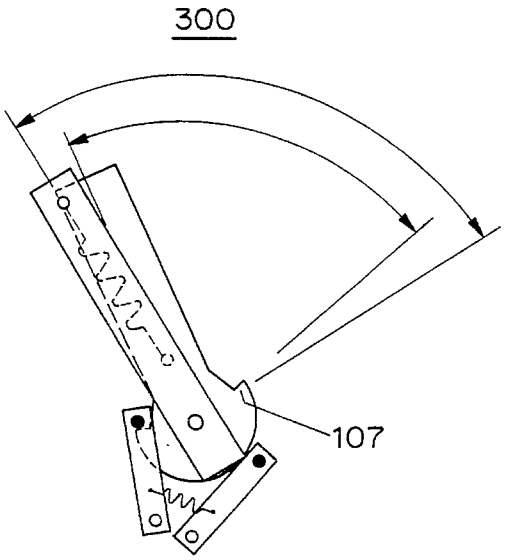
FIG. 2c PRIOR ART
FIG. 2*c* shows a conventional switching device in an even-numbered tap position, after the tap changeover has occurred.

FIG. 2*a* shows a prior art switching device 300 in an odd-numbered tap position. FIG. 2*b* shows a prior art switching device during changeover from an odd-numbered tap to an even-numbered tap. FIG. 2*c* shows a prior art switching device in an even-numbered tap position.

The conventional switching device 300 typically comprises an input lever 101 and an output lever 102 coupled by a stored-energy spring 104. The input lever 101 and the output lever 102, share a common shaft 103.

The output lever 102 has a cammed surface at its base which is generally rounded and formed concave relative to the common shaft 103. The cammed surface has a left edge and a right edge 107 which are generally formed convex relative to the common shaft 103.

A latching apparatus 320 engages the cammed surface of the output lever 102, and specifically, it selectively engages one of the left edge 108 and the right edge 107 of the cammed surface to prevent the output lever 102 from rotating freely. The latching apparatus 320 includes a left latch 110 and a right latch 109. The left latch 110 rotates on a left pivot 112 and is connected to a latch spring 113. The right latch 109 rotates on a right pivot 111 and is also connected to the latch spring 113. When positioned on the switching device, the latching apparatus 320 forms a V-shape. The spring 113 urges the left latch 110 and the right latch 109 toward one another so that the left latch 110 and the right latch 109 close on the cammed surface.

The left latch 110 engages and secures the left edge 108 of the cammed surface when the output lever 102 is fully rotated in the counterclockwise direction, i.e., the even-numbered tap position. The right latch 109 engages and secures the right edge 107 of the cammed surface when the output lever 102 is fully rotated in the clockwise direction, i.e., the odd-numbered tap position.

The latching apparatus 320 is engaged by a base section 116 of the input lever 101. As the input lever 101 rotates in the clockwise direction, the base section 116 engages the left latch 110. Conversely, as the input lever 101 rotates in the counterclockwise direction, the base 116 engages the right latch 109. The force exerted by the base 116 tends to force the latching apparatus 320 away from engagement with the cammed surface.

When, for example, a changeover from an odd-numbered tap (FIG. 2*a*) to an even-numbered tap (FIG. 2*c*) is desired, the input lever 101 is mechanically rotated in a counterclockwise direction to a predetermined angle. This position is designated by Θ 3 in FIG. 2*b*. As the input lever 101 rotates in a counterclockwise direction, the spring 104 is stretched, and potential energy builds in the spring 104.

The output lever 102 is held in place by the right latch 109, which, due to the force exerted by the latch spring 113, engages the right edge 107 of the cammed surface. As the input lever 101 rotates, a section of its base 116 forces the right latch 109 away from the right edge 107 of the cammed surface. When the force exerted by the base 116 of the input lever 101 on the right latch 109 exceeds the force exerted by the latch spring 113, the right latch 109 passes over the right edge 107 of the cammed surface, and the output lever 102 is free to rotate in a counterclockwise direction, i.e., the output lever is tripped.

At this point, the potential energy stored in the stored-energy spring 104 is released, and the output lever 102 is pulled in a counterclockwise direction toward the input lever 101. The output lever 102 continues to rotate until the left edge 108 of the cammed surface is captured by the left latch 110. At this point in time, the output lever 102 is now on the other side of the switch device 300, in the even-numbered tap position, and the changeover process is complete.

Θ 3 designates the angle formed by the input lever 101 and the output lever 102 at the moment the base 116 of the input lever 101 begins to engage the latching apparatus 320. Θ 1 designates the angular distance traveled by the input lever 101 after it has switched from the odd-numbered tap position in FIG. 2*a* to the even-numbered tap position in FIG. 2*c*. Θ 2 designates the angular distance traveled by the output lever 102 when switched from an odd-numbered tap position (FIG. 2*a*) to an even-numbered tap position (FIG. 2*c*).

With the conventional construction illustrated in FIGS. 2*a*, 2*b* and 2*c*, the base 116 of the input lever 101 drives the latching apparatus 320, thereby releasing the output lever 102, and allowing the spring 104 to pull the output lever 102. However, as shown in FIG. 2*b*, the position of the input lever 101 at this time (Θ 3) is completely determined by the shape and assembly-position relationships of the various components that comprise the device 300; hence, it has been extremely difficult with conventional devices to delay tripping the output lever 102 until after the maximum amount of energy has been stored in the spring 104. The inventive switching device 100 shown in FIGS. 1*a*–1*c* solves these problems.

Figure 1A:
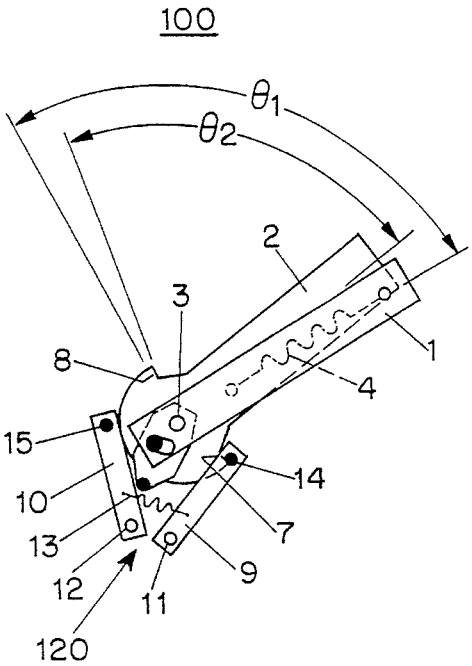
FIG. 1*a* shows a switching device according to the invention in an odd-numbered tap position.
Figure 1B:
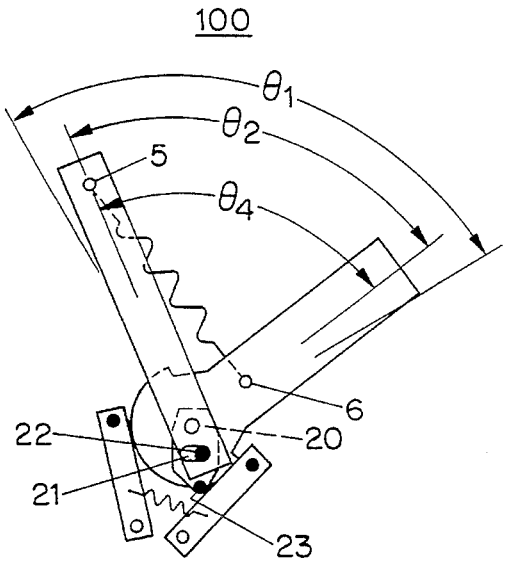
FIG. 1*b* shows a switching device according to the invention at the instant the latching lever is tripped.
Figure 1C:
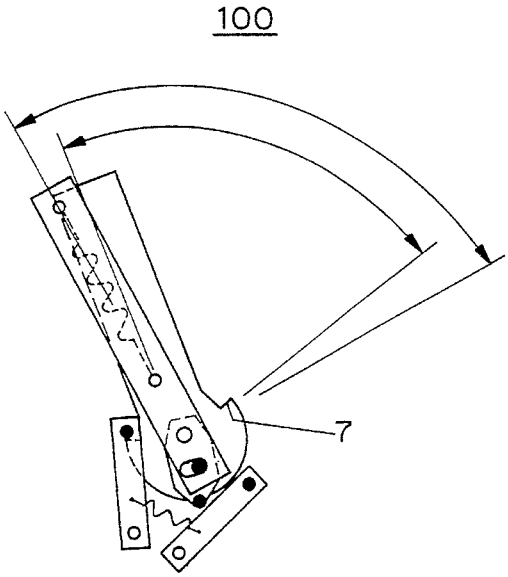
FIG. 1*c* shows a switching device according to the invention in an even-numbered tap position, after the tap changeover has occurred.

FIG. 1*a* shows the inventive switch device 100 in the odd-numbered tap position. FIG. 1*b* shows the inventive switch device at the moment an output lever 2 is tripped. FIG. 1*c* shows the inventive switch device 100 in an even-numbered tap position.

FIG. 1*a* shows the inventive switch device 100. The device 100 comprises a shaft 3 and an input lever 1 which is rotatably attached to the shaft 3. Also rotatably attached to the shaft 3 is an output lever 2. Depending on whether the device is in an odd-numbered (FIG. 1*a*) or an even-numbered (FIG. 1*c*) tap position, the output lever 2 makes contact with a selected one of a first tap and a second tap (not shown).

Referring to FIGS. 1*a* and 1*c*, the output lever 2 has a cammed surface at its base for securing a position of the output lever 2 to make contact with a selected one of the first tap and the second tap. The cammed surface also engages the latching apparatus 120 to prevent the output lever 2 from rotating about the shaft 3 until preliminary actions are complete.

Further, the device 100 has a clutch 20 which is rotatably attached to the shaft 3.

Referring to FIG. 1*b*, the device 100 has a spring 4 for pulling the output lever 2 toward the input lever 1. The spring 4 has two ends. One end is fixedly attached to a support 5 on the input lever 1 and the other end of the spring 4 is fixedly attached to a support 6 on the output lever 2. The spring 4 is utilized to store potential energy before the output lever 2 is pulled toward the input lever 1.

Referring to FIG. 1*a*, the device 100 further includes a latching apparatus 120 for engaging the clutch 20. The latching apparatus 120 has a first latch 9, a second latch 10 and a latch spring 13. The first latch 9 has a first end which is pivotally attached to a first pivot 11. The first latch 9 also has a second end which includes a first cam follower 14 for securing the output lever 2 in the first position. The first cam follower 14 engages the first edge 7 of the cammed surface to secure the position of the output lever 2.

The second latch 10 has a first end which is pivotally attached to a second pivot 12. The second latch 10 also has a second end which includes a second cam follower 15 for securing the output lever 2 in a second position making contact with the second tap. The second cam follower 15 engages the second edge 8 of the cammed surface to secure the position of the output lever 2.

The latching apparatus 120 also includes a latch spring 13 which couples the first latch 9 with the second latch 10. When the latching apparatus 120 is positioned on the switching device 100, the first latch 9 and the second latch 10 are positioned in the shape of a V.

The cammed surface at the base of the output lever 2 is disposed adjacent to the latching apparatus 120. Specifically, the cammed surface is disposed between the first latch 9 and the second latch 10. The cammed surface has a first edge 7 for engaging the latching apparatus 120 when the output lever 2 is in a first position, the output lever 2 making contact with the first tap. The cammed surface has a second edge 8 for engaging the latching apparatus 120 when the output lever 2 is in a second position, the output lever 2 making contact with the second tap.

The clutch 20 further includes a slot 21. The clutch 20 also has a roller follower 23 positioned at its base. The roller follower 23 engages the latching apparatus 120. Specifically, the roller follower 23 engages the first latch 9 when the input lever 1 is rotated in a counterclockwise direction. The roller follower 23 engages the second latch 10 when the input lever 1 is rotated in a clockwise direction.

The device 100 additionally includes a pin 22, fixedly attached to the input lever 1 and disposed within the slot 21 in the clutch 20. The pin 22 drives the clutch 20 into an engagement with the latching apparatus 120.

The pin 22, integrated into the input lever 1, is disposed in the slot 21. The pin 22 moves the clutch 20 when it engages either a left wall or a right wall of the slot 21. However, this will occur only after the input lever 1 has been rotated to a predetermined angle (Θ 4), from the output lever 2.

Once a selected one of the left and right wall is engaged, then further rotation of the input lever 1 will drive the clutch 20.

Referring to FIGS. 1*a*–1*c*, the switching device 100 operates as follows:

Initially, the input lever 1 is pulled away, by means previously shown in FIG. 3, from the output lever 2. During this time, the clutch 20 remains in a stationary position because the pin 22 is freely moving within the slot 21 in the clutch 20. As the input lever 1 is pulled, the spring 4 is stretched. Once the input lever 1 has been rotated to a predetermined angle from the output lever 2 (designated by Θ 4), the pin 22 comes in contact with a side wall of the slot 21 and begins to drive the clutch 20 against the latching apparatus 120. The roller following 23, disposed on the base of the clutch 20, engages the latching apparatus 120 and applies a force. As a result, the latching apparatus 120 is freed from an edge of the cammed surface, allowing the output lever 2 to freely rotate about the shaft 3. Due to the potential energy in the spring 4, the output lever 2 is then pulled toward the input lever 1 to make contact with the second tap.

When, for example, a changeover from an odd-numbered tap (FIG. 1*a*) to an even-numbered (FIG. 1*c*) tap is desired, the input lever 1 is mechanically rotated in a counterclockwise direction to a predetermined angle from the output lever 2, designated by Θ 4 in FIG. 1*b*. As the input lever 1 rotates in a counterclockwise direction, the spring 4 is stretched, thereby transferring potential energy to the spring 4.

The output lever 2 is held in place by the first latch 9, via the first cam follower 14. The latch spring 13 provides the first cam follower 14 with the force necessary to secure the first edge 7 of the cammed surface.

Unlike the prior art device described above, the inventive switch device 100 does not use a base section of the input lever 1 to engage the latching apparatus 120. The inventive device 100 utilizes the idle clutch 20 to engage the latching apparatus 120.

In the configuration of FIG. 1*a*, the idle clutch 20 forms an angle with the central axis of the input lever 1, wherein the angle faces to the left.

In the configuration of FIG. 1*c*, the idle clutch 20 forms an angle with the central axis of the input lever 1, wherein the angle faces to the right.

The slot 21 within the idle clutch 20 is shaped to coincide with an orbit of the pin 22, as the pin rotates about the shaft 3. The orbit shape of the slot 21 enables the pin 22 to rotate freely within the slot 21.

In sum, changing the device from an odd-numbered tap, as seen in FIG. 1*a*, to an even-numbered tap, as seen in FIG. 1*c*, involves a number of steps. As seen in FIG. 1*b*, the pin 22, because of the slot 21, can not move the clutch plate 20 until the input lever 1 moves from the start position to Θ 4. The pin 22 only comes into contact with the right side of the slot 21 after the input lever 1 has been rotated a predetermined angle, Θ 4, from the output lever 2. When the pin 22 strikes the right wall of the slot 1, the clutch 20 rotates further in a counter-clockwise direction, and causes the roller follower 23 to engage the first latch 9. As input lever 1 continues to rotate further, roller follower 23 forces the first latch 9 to release the first edge 7 of the cammed surface. By the time the first latch 9 disengages the first edge 7, the spring 4 has been stretched to its maximum length. The disengagement of the first edge 7 allows the output lever 2 to rotate in a counter-clockwise direction. The spring 4 then pulls the output lever 2 in the counter-clockwise direction and the tap-changeover takes place. After the tap-changeover, the device is in the even-numbered tap position shown in FIG. 1*c*.

The tap changeover steps described above can be reversed, thereby enabling one to switch the tap from an even-numbered tap to an odd-numbered tap, i.e., going from FIG 1*c* to FIG. 1*a*.

In sum, the inclusion of the idle clutch 20 to the switch device 100 enables one to better control the position of the input lever 1 when the output lever 2 is tripped. The idle clutch 20 also enables one to stretch the spring 4 substantially before the output lever 2 is tripped, because the input lever 1 in the inventive device can be positioned at a greater angle from the output lever 2 before the output lever 2 is tripped. Thus, the operation of the output lever 2 can begin with greater force than with conventional devices. Therefore, action delays, which have been a serious problem involved with the prior art changeover switches, can be avoided, and the changeover switch contacts can be effectively made.

In accordance with the features of the invention, the inclusion of the idle clutch 20 allows the device 100 to have a smaller cammed surface. Advantageously, the spacing between the two latches 9 and 10 can be reduced. In addition, since the size of the cammed surface of the output lever 2 can be reduced, the structural dimensions around the latching apparatus 120 can be accordingly reduced.

Because the point of engagement between the roller follower 23 and the latching apparatus 120 can be controlled by design, it is possible to trip the output lever 2 with only a small displacement of the clutch 20. This feature enables one to enhance the precision of the switch device 100.

We claim:

1. A switching device for a tap changer comprising:

a shaft;

an input lever rotatably mounted on to the shaft;

a clutch, rotatably attached to the shaft, having a slot;

a latching apparatus for engaging the clutch;

an output lever, rotatably attached to the shaft, for making contact with a selected one of a first tap and a second tap, said output lever having a cammed surface at a base thereof for securing a position of said output lever to make contact with the first tap and for engaging the latching apparatus to prevent said output lever from rotating about the shaft;

a spring for pulling the output lever toward the input lever; and a pin, fixedly attached to the input lever and disposed within the slot, for driving the clutch to engage the latching apparatus;

whereby when the input lever is pulled away from the output lever by a predetermined angle, said pin drives the clutch against the latching apparatus to free the cammed surface from the latching apparatus, allowing the output lever to rotate about the shaft, and the output lever is then pulled by the spring toward the input lever to make contact with the second tap.

2. The switching device of claim 1, wherein the spring has two ends and is fixedly attached to the input lever at one end and the output lever at the other end.

3. The switching device of claim 1, wherein the spring is used to store potential energy before the output lever is pulled toward the input lever.

4. The switching device of claim 1, wherein the cammed surface is disposed adjacent to the latching apparatus.

5. The switching device of claim 1, wherein the cammed surface has a first edge for engaging the latching apparatus when the output lever is in said position, and a second edge for engaging the latching apparatus when the output lever is in a second position making contact with the second tap.

6. The switching device of claim 1, wherein the latching apparatus comprises:

a first latch having a first end pivotally attached to a first pivot, and a second end including first means for securing the output lever in said first position;

a second latch having a first end pivotally attached to a second pivot, and a second end including second means for securing the output lever in a second position making contact with the second tap; and a latch spring for coupling the first latch with the second latch.

7. The switching device of claim 6, wherein the cammed surface is disposed between the first latch and the second latch.

8. The switching device of claim 6, wherein the first means includes a cam follower for engaging an edge of the cammed surface to secure the position of the output lever.

9. The switching device of claim 6, wherein the second means includes a cam follower for engaging an edge of the cammed surface to secure the position of the output lever.

10. The switching device of claim 1, wherein the clutch includes a roller at a base thereof for engaging the latching apparatus.

* * * * *

UNITED STATES PATENT AND TRADEMARK OFFICE

CERTIFICATE OF CORRECTION

PATENT NO. : 5,488,212

DATED : January 30, 1996

INVENTOR(S) : Fukushi et al.

It is certified that error appears in the above-indentified patent and that said Letters Patent is hereby corrected as shown below:

Column 2, line 40, "retains 30" should read --retains--;

Column 4, line 2, "following" should read --follower--;

Column 5, line 36, "$203D_3$" should read --$207D_3$--;

Column 6, line 34, "left edge" should read --left edge 108--;

Column 9, line 51, "slot 1" should read --slot 21--;

Column 10, line 30, "on to" should read --on--;

Column 10, line 33, "attached to" should read --mounted on--.

Signed and Sealed this

Twentieth Day of August, 1996

*Attest:*

Bruce Lehman

BRUCE LEHMAN

*Attesting Officer*

*Commissioner of Patents and Trademarks*